US010434810B2

(12) United States Patent
Nakamura et al.

(10) Patent No.: US 10,434,810 B2
(45) Date of Patent: Oct. 8, 2019

(54) BOOK BLOCK FORMING APPARATUS

(71) Applicant: Horizon International Inc., Takashima-shi, Shiga (JP)

(72) Inventors: Yoshikazu Nakamura, Takashima (JP); Hiroki Yamamoto, Takashima (JP); Osamu Nishimura, Takashima (JP); Manami Umemoto, Takashima (JP)

(73) Assignee: HORIZON INTERNATIONAL INC., Takashima-shi, Shiga (JP)

( * ) Notice: Subject to any disclaimer, the term of this patent is extended or adjusted under 35 U.S.C. 154(b) by 1 day.

(21) Appl. No.: 15/736,116

(22) PCT Filed: Jun. 23, 2015

(86) PCT No.: PCT/JP2015/068060
§ 371 (c)(1),
(2) Date: Dec. 13, 2017

(87) PCT Pub. No.: WO2016/207977
PCT Pub. Date: Dec. 29, 2016

(65) Prior Publication Data

US 2018/0186162 A1 Jul. 5, 2018

(51) Int. Cl.
*B42C 19/04* (2006.01)
*B42C 9/00* (2006.01)

(52) U.S. Cl.
CPC ..... *B42C 19/04* (2013.01); *B42C 9/0081* (2013.01)

(58) Field of Classification Search
CPC ..... B42C 1/12; B42C 19/04; B42C 9/0006; B42C 9/0081
See application file for complete search history.

(56) References Cited

U.S. PATENT DOCUMENTS 5,702,219 A 12/1997 Hattori
6,328,519 B1 * 12/2001 Nagai ..... B42C 5/00 412/37

(Continued)

FOREIGN PATENT DOCUMENTS

JP 56-117692 A 9/1981
JP 8-58267 A 3/1996

(Continued)

OTHER PUBLICATIONS

International Search Report dated Sep. 29, 2015, issued in counterpart International Application No. PCT/JP2015/068060 (2 pages).

(Continued)

*Primary Examiner* — David R Dunn
*Assistant Examiner* — Christopher E Veraa
(74) *Attorney, Agent, or Firm* — Westerman, Hattori, Daniels & Adrian, LLP

(57) ABSTRACT

A first press unit 2 presses each of a plurality of signatures S along a fold f, the signatures being supplied one at a time with the fold facing forward. The unit is arranged a signature conveyance unit 3 that conveys each signature received from the first press unit while controlling the attitude to make the fold orthogonal to the conveyance direction. The unit is arranged a gluing unit 4 that applies glue to both lateral edges of a top surface of each signature received from the signature conveyance unit. The unit is arranged an accumulation unit 5 that sequentially stacks the signatures received from the gluing unit on one another while jogging the stacked signatures to form a book block B. The unit is arranged a second press unit 6 that discharges the book block received from the accumulation unit after pressing the same along the folds.

7 Claims, 5 Drawing Sheets

(56) References Cited

U.S. PATENT DOCUMENTS

| | | | | |
|---|---|---|---|---|
| 8,871,047 | B2 | 10/2014 | Hunkeler et al. | |
| 2005/0120607 | A1 | 6/2005 | Austin | |
| 2007/0272361 | A1* | 11/2007 | Cracknell | B42C 1/12 156/578 |
| 2010/0015414 | A1 | 1/2010 | Hunkeler et al. | |
| 2010/0051196 | A1 | 3/2010 | Hunkeler et al. | |
| 2014/0353958 | A1 | 12/2014 | Hunkeler et al. | |
| 2015/0043997 | A1 | 2/2015 | Ohno et al. | |
| 2015/0110580 | A1* | 4/2015 | Knauer | B42C 1/12 412/35 |

FOREIGN PATENT DOCUMENTS

| | | | |
|---|---|---|---|
| JP | 2000-158847 | A | 6/2000 |
| JP | 2006-315255 | A | 11/2006 |
| JP | 2010-52432 | A | 3/2010 |
| JP | 2011-20432 | A | 2/2011 |
| JP | 2015-36197 | A | 2/2015 |

OTHER PUBLICATIONS

Extended Search Report dated Jan. 4, 2019, issued in counterpart European Application No. 15896299.3 (5 pages).

* cited by examiner

[Fig. 1]
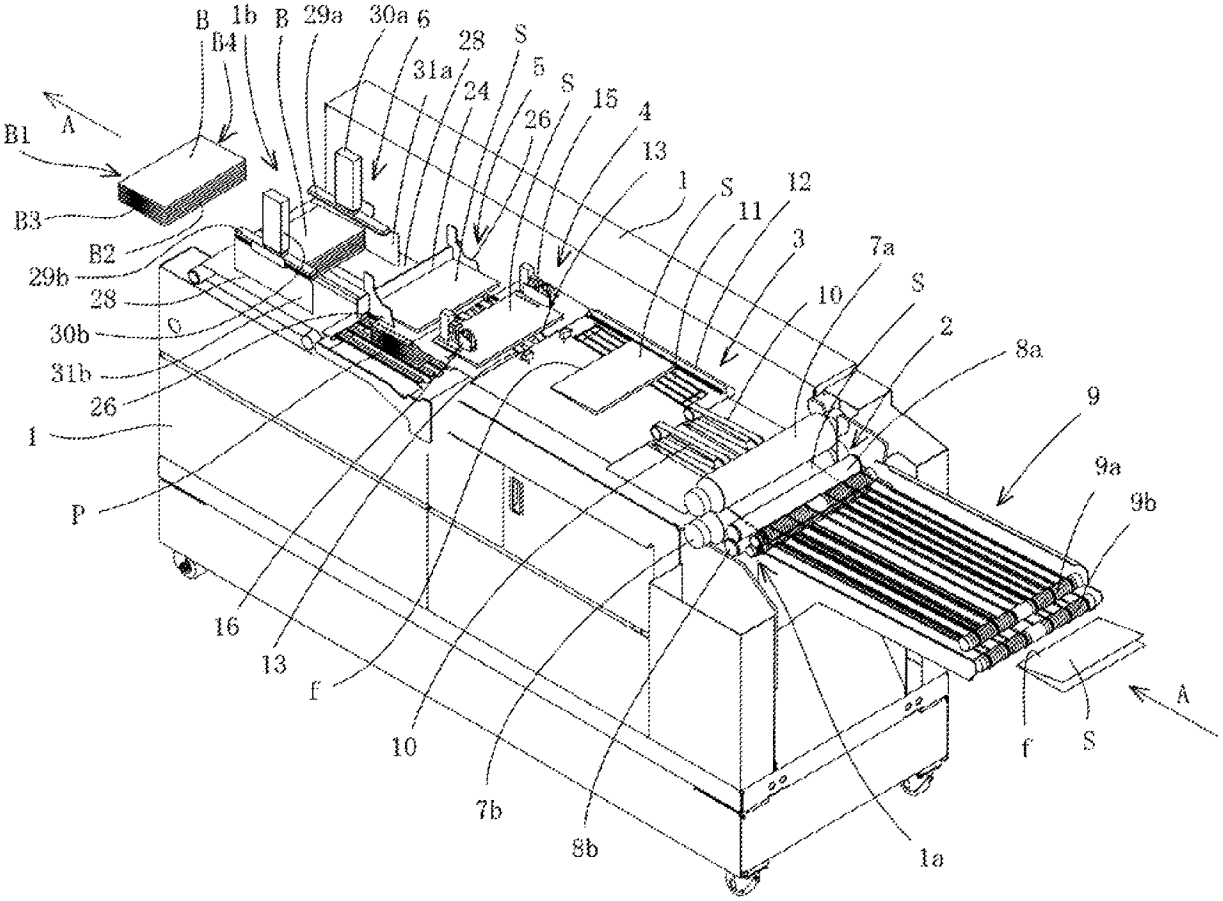

[Fig. 2B]
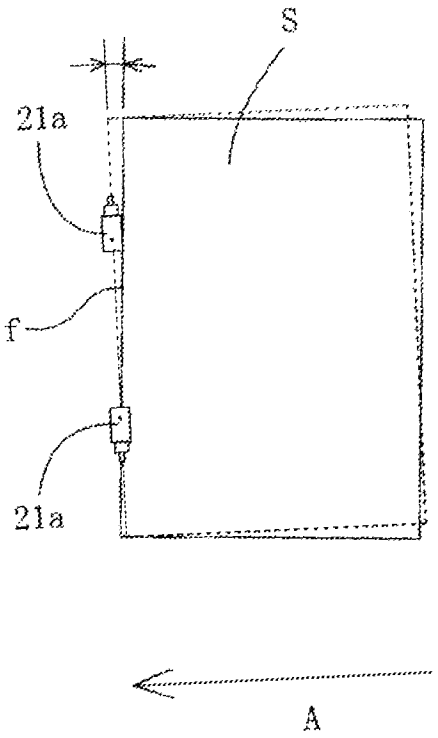
[Fig. 2A]
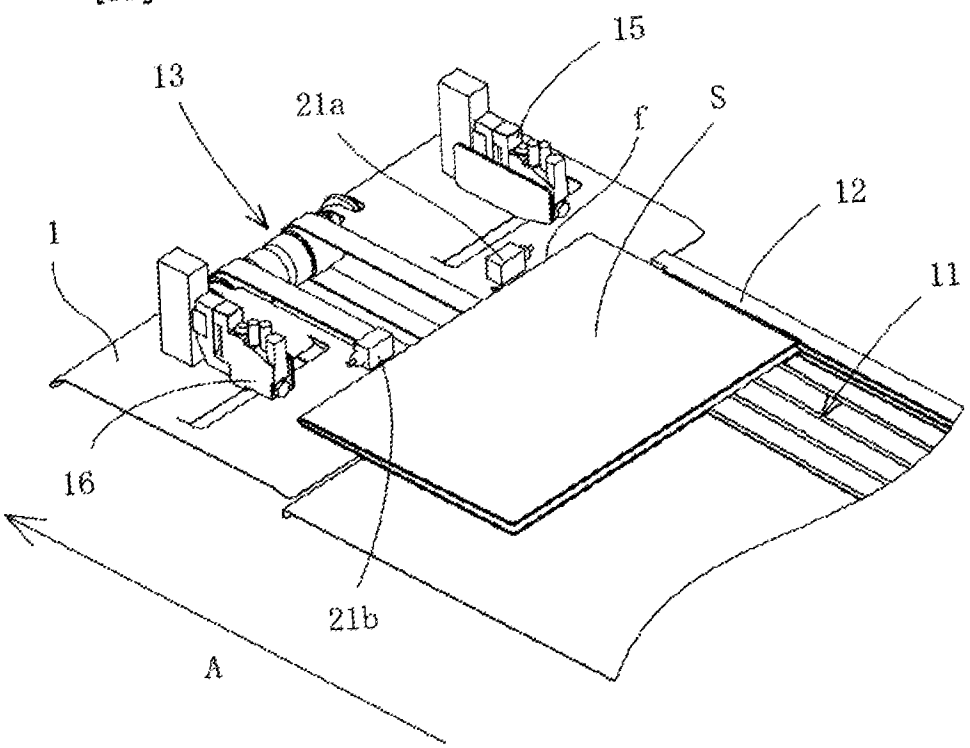

[Fig. 3C]
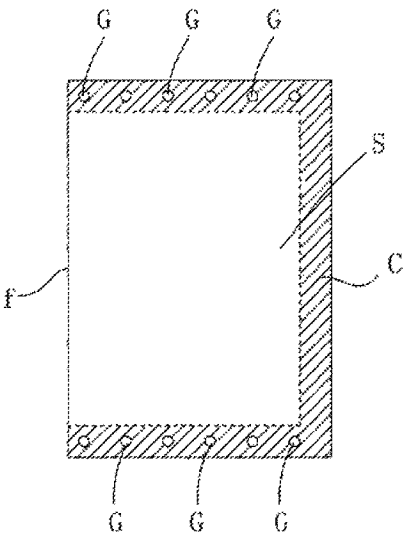
[Fig. 3A]
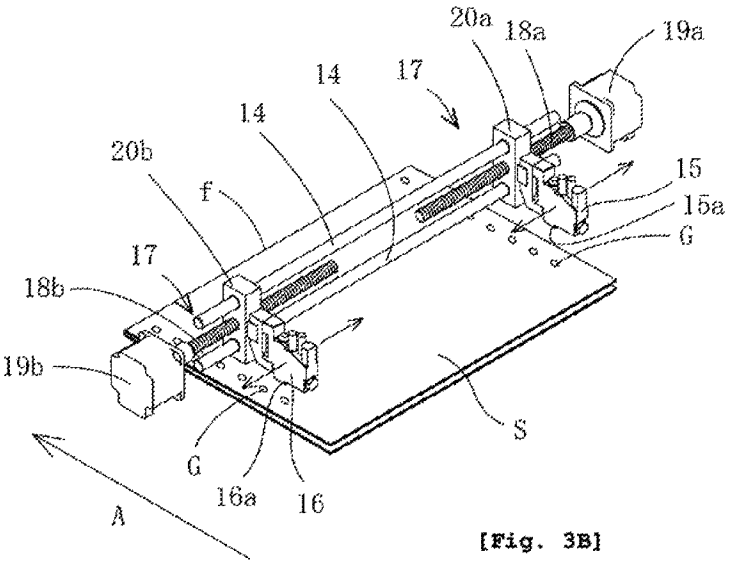
[Fig. 3B]
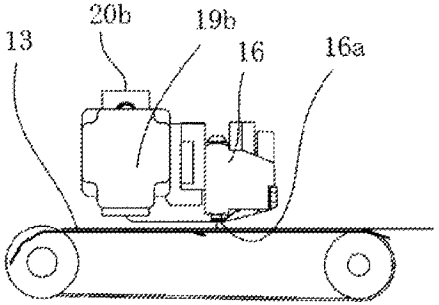

[Fig. 4B]
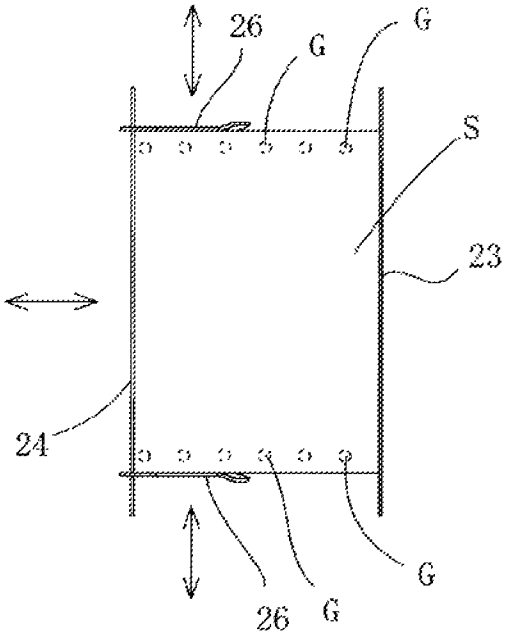
[Fig. 4A]
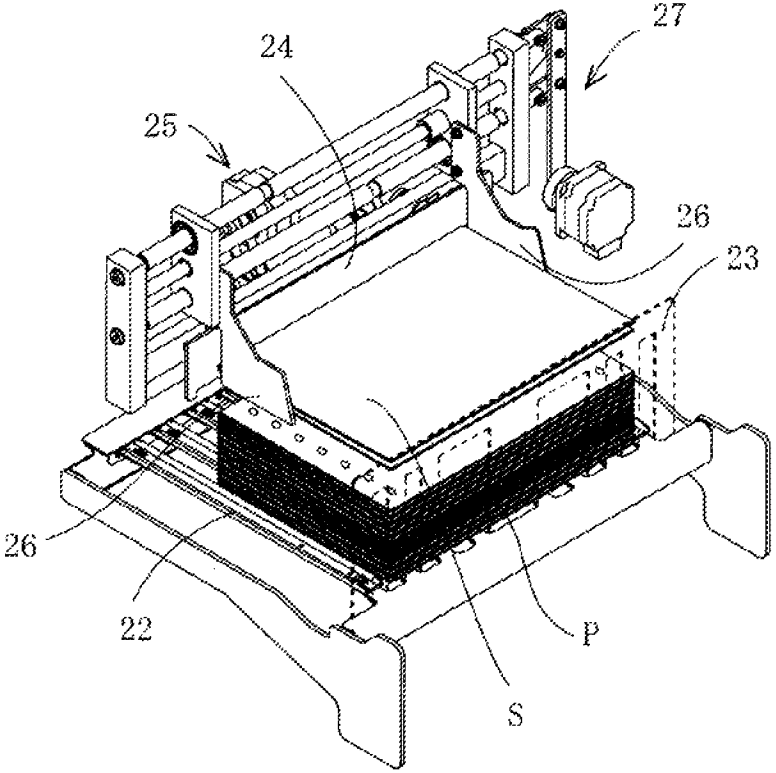

[Fig. 5A]
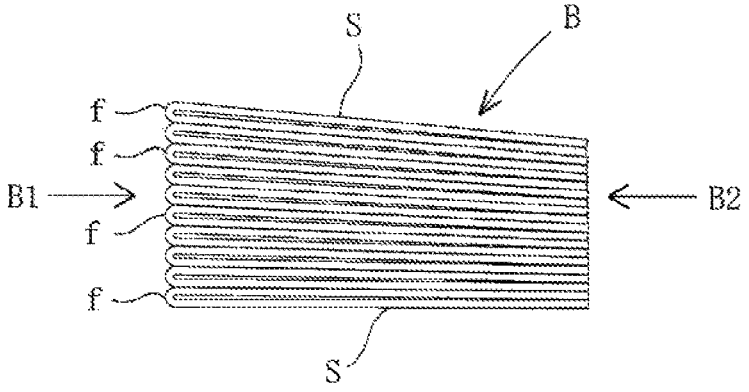
[Fig. 5B]
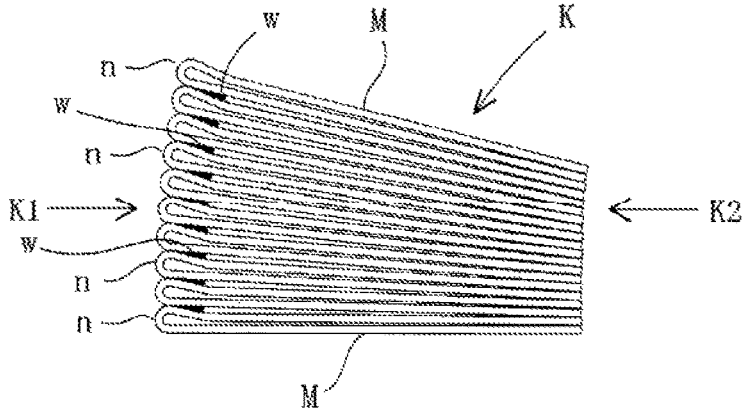
[Fig. 5C]
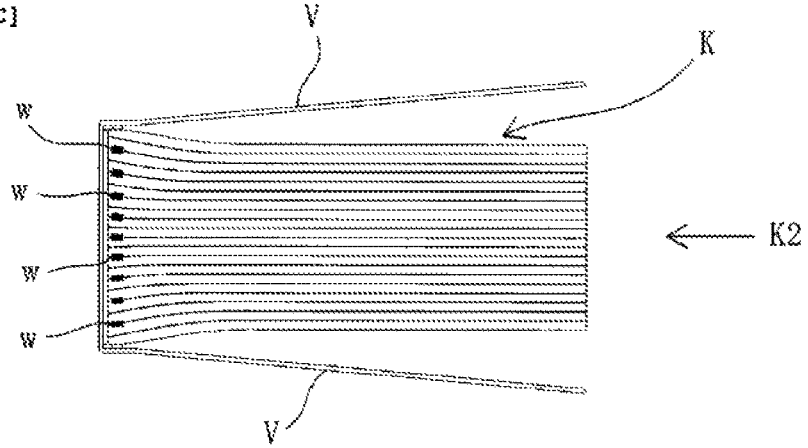

BOOK BLOCK FORMING APPARATUS

TECHNICAL FIELD

The present invention relates to an apparatus for forming a book block composed of collated signatures.

BACKGROUND ART

In a conventional book binding process, signatures are formed by printed sheets folded one or more times, and a book block is formed by collating the signatures, and the book block is cut at a spine thereof, and glue is applied to the trimmed spine of the book block, and a cover is attached to the spine of the book block, and the covered book block is trimmed by a three side trimmer to form a book.

In the prior art, there are some book block forming apparatuses for collating signatures to form a book block.

For example, according to an apparatus disclosed in Patent Document 1, each of printed sheets is folded along travelling direction thereof two or three times According to this apparatus, in order to avoid misalignment of the signatures in the book block, the signatures are adhered to each other, and thereby it is not necessary to align the signatures again in the subsequent process.

FIG. 5B is a side view of such book block. Referring to FIG. 5B, one side face K1 close to a glue-applied area forms a spine of a book block K, and the opposite side face K2 forms a fore edge of the book block K.

In the subsequent process, as shown in FIG. 5C, the spine K1 of the book block K is cut, glue is applied to the spine K1 and a cover V is attached to the spine K1 through the glue. Thereafter, the book block K with the cover V is trimmed at the fore edge K2 as well as top and bottom edges thereof so as to be shaped into a book.

However, the book manufactured in such a manner has disadvantage that readers have trouble opening the book because glue joints w formed between signatures M during formation of the book block K are left in back margins of the book.

Also, in the above-mentioned book block forcing apparatus, as shown in FIG. 5B, the signatures M are stacked in a manner such that a fold line n side (the spine K1) of the stack is thicker than the opposite side (the fore edge K2) of the stack, and consequently, the book block K whose spine K1 warps is formed.

Then when this book block K is pressed and so on in the subsequent process, the signatures M sometimes wrinkle because of warping of the spine K1, which leads to deterioration of book binding. This is noticeable when a book block has a large number of signatures.

PRIOR ART DOCUMENTS

Patent Documents

Patent Document 1: JP 2010-52432 A

SUMMARY OF THE INVENTION

Problems to be Solved by the Invention

It is, therefore, an object of the present invention to provide an apparatus capable of forming a book block effecting high quality book binding.

Means for Solving the Problems

In order to achieve the object, the present invention provides a book block forming apparatus comprising: a frame having an entrance and an exit; a first press unit attached to the entrance of the frame to press each of signatures along a fold line thereof, the signatures being supplied one by one to the first press unit with the fold line in the head thereof; a signature conveyance unit attached to the frame and arranged downstream of the first press unit to convey the signatures received from the first press unit while controlling attitudes of the signatures in a manner such that the fold lines are perpendicular to the conveying direction; a glue application unit attached to the frame and arranged downstream of the signature conveyance unit to apply glue to both sides of the top face of each of the signatures received by the signature conveyance unit; an accumulation unit attached to the frame and arranged downstream of the glue application unit to form a book block by stacking the signatures received from the glue application unit while jogging the stack of signatures; and a second press unit attached to the frame and arranged downstream of the accumulation unit to receive and vertically press the book block fed from the accumulation unit and discharge the pressed book block from the exit of the frame.

Here, when a signature is formed by multiple folding of a sheet, "a fold line" of the signature means "a fold line formed by the last folding" (the same applies hereinafter).

According to a preferred embodiment of the present invention, the glue application unit comprises: a first conveyer belt attached to the frame to convey the signatures received from the signature conveyance unit; one or more slide guides attached to the frame and arranged above the first conveyer belt so as to be extended perpendicularly across the first conveyer belt; a pair of glue injection heads slidably mounted on the slide guides and having one or more glue injection nozzles to spray glue in both sides of upper surfaces of the signatures being conveyed by the first conveyer belt; a first drive mechanism attached to the frame to slide the pair of glue injection heads; and one or more first sensors arranged upstream of the pair of glue injection heads to detect passage of front ends of the signatures, wherein the pair of glue injection heads is activated by detection signals outputted from the first sensors.

According to another preferred embodiment of the present invention, the first drive mechanism of the glue application unit comprises: a pair of ball screws arranged above both sides of the first conveyer belt, each of the ball screws-extending parallel with the slide guides and supported by the frame so as to be rotatable about an axis thereof; a pair of motors attached to the frame and arranged at both sides of the first conveyer belt to rotate the associated ball screws; and a nut member engaged with each of the ball screws, the glue injection heads being attached to the associated nut members.

According to further preferred embodiment of the present invention, the accumulation unit comprises: a vertically movable shelf arranged downstream of a downstream end of the first conveyer belt of the glue application unit, the signatures discharged from the first conveyer belt being stacked on the shelf; a second drive mechanism attached to the frame to move the shelf up and down; a height detection sensor attached to the frame to detect a height of the stack of signatures on the shelf, the shelf being lowered by a predetermined distance based on detection signals of the height detection sensor every time the height of the stack of signatures is increased to the predetermined distance; a first jogging mechanism jogging front and back surfaces of the stack of signatures on the shelf; and a second jogging mechanism jogging side surfaces of the stack of signatures on the shelf, wherein the first jogging mechanism comprises:

a back alignment plate attached to the frame and arranged at an upstream end of the shelf so as to be extended vertically to the shelf and perpendicularly to the conveying direction; a front alignment plate arranged at downstream of and parallel with the back alignment plate to jog the front and back surfaces of an upper portion of the stack of signatures in cooperation with the back alignment plate; and a third drive mechanism attached to the frame to reciprocate the front alignment plate in the conveying direction, wherein the second jogging mechanism comprises: a pair of side alignment plates arranged at both sides of the shelf so as to be extended vertically to the shelf and in the conveying direction to jog the side surfaces of the upper portion of the stack of signatures; and a fourth drive mechanism attached to the frame to reciprocate one of the side alignment plates perpendicular to the conveying direction while maintaining a predetermined distance between the side alignment plates, wherein the accumulation unit further comprises a pushing mechanism pushing the book block from the shelf lowered at the lowest position to the second press unit.

According to further embodiment of the present invention, the first press unit comprises: a pair of horizontal press rollers arranged one above the other so as to be extended perpendicular across the conveying direction and supported by the frame to be rotatable about axes thereof; and a fifth drive mechanism attached to the frame to rotate the horizontal press rollers.

According to further preferred embodiment of the present invention, the second press unit comprises: a second horizontal conveyer belt conveying the book block discharged from the accumulation unit by the pushing mechanism to the exit of the frame, a press station being provided on a medium portion of a conveyance surface of the second conveyer belt; a pair of vertically movable press plates arranged above the press station and parallel with each other in a width direction of the second conveyer belt, each of the press plates extending in the conveying direction; a sixth drive mechanism arranged for concurrently moving the press plates up and down in a manner such that the press plates can be moved between a standby position in which the press plates separate upwardly from the book block on the second conveyer belt and a press position in which the press plates press both sides of a upper surface of the book block downwardly; and a second sensor for detecting when the book block arrives at the press station, wherein the second conveyer belt is temporally stopped when a detection signal is outputted from the second sensor, and during the temporal stopping of tire second conveyer belt, the pair of press plates is moved down from the standby position to the press position and moved up from the press position to the standby position.

According to further preferred embodiment of the present invention, the signature conveyance unit comprises: a third horizontal conveyer belt attached to the frame and arranged at an angle with respect to the conveying direction to convey the signatures from the first press unit to the first conveyer belt; an alignment ruler extending in the conveying direction on the conveyance surface of the third conveyer belt; and a seventh drive mechanism attached to the frame to support the alignment ruler and move the alignment ruler in a direction perpendicular to the conveying direction.

Effect of the Invention

According to the present invention, the signatures are pressed one by one by the first press unit along the fold line thereof and conveyed by the signature conveyance unit while the attitudes thereof being controlled in such a way that the fold lines are perpendicular to the conveying direction. Then, in the glue application unit, glue is applied to both sides of the top face of each of the signatures, and the signatures are stacked in the form of a book block by the accumulation unit, and the book block is pressed by the second press unit.

A front surface (fold line side end faces of the signatures), a rear surface (the opposite end faces of the signatures) and side surfaces of the book block forms a spine, a fore edge and top and bottom edges of the book block, respectively, and in the subsequent process, cutting of the spine of the book block, glue application and cover attachment to the cut spine are sequentially performed and thereafter, the book block with the cover is trimmed by the three side trimmer at the fore edge and top and bottom edges thereof so as to be shaped into a book.

In this case, glue joints formed between signatures during formation of the book block are cut off by three side trimming so that the book does not have the glue joints between the signatures. Thus the book can be smoothly opened.

Further, according to the present invention, the signatures are stacked after each of the signatures is pressed along the fold line thereof by the first press unit and thereby, warpage of the front surface of the book block is controlled. Consequently, even though a book block is composed of a number of signatures, book binding errors such as the occurrence of wrinkles in the signatures can be prevented.

The pressing by the first press unit is particularly effective in case of making a book block of signatures which are formed by multiple folding of a sheet in directions perpendicular to each other, for example, by folding a sheet in half in a width direction after folding the sheet in half in a length direction.

BRIEF DESCRIPTION OF THE DRAWINGS

FIG. 1 is a schematic perspective view of a book block forming apparatus according to an embodiment of the present invention.

FIG. 2A is a perspective view showing a connection of a signature conveyance unit and a glue application unit of the book block forming apparatus.

FIG. 2B is a plan view of a signature passing through a sensor of the glue application unit.

FIG. 3A is a perspective view of the glue application unit of the book block forming apparatus.

FIG. 3B is a side view of the glue application unit.

FIG. 3C is a plan view of a signature to which glue is applied by the glue application unit.

FIG. 4A is a perspective view of an accumulation unit of the book block forming apparatus.

FIG. 4B is a plan view illustrating movement of a jogging mechanism of the accumulation unit.

FIG. 5A is a side view of a book block formed by the book block forming apparatus of the present invention.

FIG. 5B is a side view of a book block formed by a conventional book block forming apparatus.

FIG. 5C is a side view of the book block formed by the conventional book block forming apparatus when a cover is attached to the book block.

BEST MODE FOR CARRYING OUT THE INVENTION

A preferred embodiment of the present invention will be explained below with reference to accompanying drawings.

FIG. 1 is a schematic perspective view of a book block forming apparatus according to an embodiment of the present invention.

Referring to FIG. 1, the book block forming apparatus of the present invention comprises a frame 1 which has an entrance 1*a* and an exit 1*b*, a first press unit 2 which is attached to the entrance 1*a* of the frame 1 to press each of signatures S along a fold line f thereof, the signatures S being supplied one by one to the first press unit 2 with the fold line f in the head thereof, and a signature conveyance unit 3 which is attached to the frame 1 and arranged downstream of the first-press unit 2 to convey the signatures S received from the first press unit 2 while controlling attitudes of the signatures S in a manner such that the fold lines f are perpendicular to the conveying direction of the signatures S (indicated by an arrow A).

Here, when a signature S is formed by multiple folding of a sheet, "a fold line f" of the signature S means "a fold line formed by the last folding" (the same applies hereinafter).

The book block forming apparatus further comprises a glue application unit 4 which is attached to the frame 1 and arranged downstream of the signature, conveyance unit 3 to apply glue G to both sides of the top face of each of the signatures S received by the signature conveyance unit, an accumulation unit 5 which is attached to the frame 1 and arranged downstream of the glue application unit 4 to form a book block B by stacking the signatures S received from the glue application unit 4 while jogging the stack of signatures S, and a second press unit 6 which is attached to the frame 1 and arranged downstream of the accumulation unit 5 to receive and vertically press the book block B fed from the accumulation unit 5 and discharge the pressed book block B from the exit 1*b* of the frame 1.

In this embodiment, the first press unit 2 comprises a pair of horizontal press rollers 7*a*, 7*b* which are arranged one above the other so as to be extended perpendicular across the conveying direction and supported by the frame 1 so as to be rotatable about axes thereof, a pair of auxiliary press rollers 8*a*, 8*b* which are arranged one above the other and parallel to the press roller pair 7*a*, 7*b* and supported by the frame 1 so as to be rotatable about axes thereof, and a roller drive mechanism (not shown) attached to the frame to rotate the press roller pair 7*a*, 7*b* and the auxiliary press roller pair 8*a*, 8*b*.

The pair of auxiliary press rollers 8*a*, 8*b* is provided as necessary.

A signature feed unit 9 is connected to the entrance 1*a* of the frame 1 to supply the signatures S, which are discharged from a sheet folding apparatus (not shown) arranged upstream of the book block forming apparatus, one by one between the pair of auxiliary press rollers 8*a*, 8*b*.

In this embodiment, the signature feed unit 9 comprises of a pair of horizontal conveyer belts 9*a*, 9*b* arranged one above the other, and the signatures S are conveyed between the pair of conveyer belts 9*a*, 9*b*.

Thus each of the signatures S supplied from the signature feed unit 9 is pressed along the fold line f thereof while passing through the auxiliary press roller pair 8*a*, 8*b* and press roller pair 7*a*, 7*b* of the first press unit 2 with the fold line f in the head thereof.

FIG. 2A is a perspective view showing a connection of the signature conveyance unit, and the glue application unit, of the book block forming apparatus, and FIG. 2B is a plan view of a signature passing through a sensor of the glue application unit.

Referring to FIGS. 1 and 2A, in this embodiment, the signature conveyance unit 3 comprises a horizontal upstream conveyer belt 10 attached to the frame 1 so as to be extended from an exit of the first press unit 2 in the conveying direction of the signatures S (arrow A), a downstream conveyer belt 11 attached to the frame 1 so as to be extended from an output end of the upstream conveyer belt 10 at an angle with respect to the conveying direction (arrow A), an alignment ruler 12 extending in the conveying direction on the conveyance surface of the downstream conveyer belt 11, and a ruler drive mechanism (not shown) attached to the frame 1 to support the alignment ruler 12 and move the alignment ruler 12 in a direction perpendicular to the conveying direction (arrow A).

The alignment ruler 12 is moved to a predetermined position by the ruler drive mechanism and fixed in the position during setting of the book block forming apparatus before the start of operation.

Thus each of the signatures S discharged from the first press unit 2 is conveyed on the upstream conveyer belt 10 of the signature conveyance unit 2 and further conveyed to the glue application unit 3 by the downstream conveyer belt 11 while bringing one side thereof into contact with the alignment ruler 12, and thereby, the attitudes of the signatures S are controlled in a manner such that the fold lines f of the signatures S are perpendicular to the conveying direction (arrow A).

FIG. 3A is a perspective view of the glue application unit of the book block forming apparatus, FIG. 3B is a side view of the glue application unit, and FIG. 3C is a plan view of the signature to which glue is applied by the glue application unit.

Referring to FIGS. 2A, 3A and 3B, the glue application unit 4 comprises a conveyer belt 13 attached to the frame 1 to convey the signatures S received from the conveyer belt 11 of the signature conveyance unit 3. Above the conveyer belt 13, slide guides 14 are attached to the frame 1 so as to be extended perpendicularly across the conveyer belt 13.

A pair of glue injection heads 15, 16 slidably mounted on the slide guides 14. The glue injection heads 15, 16 have one or more glue injection nozzles 15*a*, 15*a* to spray glue G in both sides of upper surf aces of the signatures S being conveyed on the conveyer belt 13.

The pair of glue injection heads 15, 16 is slid by a head drive mechanism 17 attached to the frame 1.

The head drive mechanism 17 comprises a pair of ball screws 18*a*, 18*b* arranged above both sides of the conveyer belt 13. Each of the ball screws 18*a*, 18*b* extends parallel with the slide guides 14 and is supported by the frame 1 so as to be rotatable about an axis thereof.

The head drive mechanism 17 further comprises a pair of motors 19*a*, 19*b* attached to the frame 1 and arranged at both sides of the conveyer belt 13 to rotate the associated ball screws 18*a*, 18*b*, and a nut member 20*a*, 20*b* engaged with each of the ball screws 18*a*, 13*b*.

The glue injection heads 15, 16 are attached to the associated nut members 20*a*, 20*b* so as to be slid along the slide guides 14 by forward and reverse rotations of the motors 19*a*, 19*b*.

Positions of the glue injection heads 15, 16 are set depending on an overall width of the signature S and a width of each margin of the both sides of the signature S during setting of the book block forming apparatus before the start of operation.

As shown in FIG. 2A, a pair of sensors 21*a*, 21*b* is arranged at an entrance of the glue application unit 4 to detect passage of front ends of the signatures S. The sensors 21*a*, 21*b* are spaced from each other in a direction perpendicular to the conveying direction (arrow A). Then the pair of glue injection heads 15, 16 is activated by detection signals outputted from the sensors 21*a*, 21*b* so that the glue is sprayed to the signatures S.

As shown in FIG. 2B, in this embodiment, a skew of the signature S is detected based on deviation of the detection time between the sensors 21*a*, 21*b*. Thus when the deviation of the detection time exceeds a predetermined threshold, it is determined that the signature S skews, and the book block B having such signature S is removed at the time of discharge of book blocks B from the book block forming apparatus.

The skew detection of the signatures provides the following effects.

Even though glue is applied to a skewed signature S by the glue application unit 4, there is no difference in appearance between a book block B having such signature S and a book block B composed of only signatures 8 to which glue is applied correctly because the signatures S are jogged during stacking the signatures S in the accumulation unit 5. Therefore, without detecting the skew of the signatures S, it is impossible to remove the signature S with glue application error before a checking of the manufactured book. Thus waste of a book binding process can be eliminated by detecting the skew of the signatures S.

FIG. 4A is a perspective view of an accumulation unit of the book block forming apparatus and FIG. 4B is a plan view illustrating movement of a jogging mechanism of the accumulation unit.

Referring to FIGS. 1 and 4A, the accumulation unit 5 comprises a vertically movable shelf 22 arranged downstream of a downstream end of the conveyer belt 13 of the glue application unit 4, and the signatures S discharged from the conveyer belt 13 are stacked on the shelf 22. The accumulation unit 5 also comprises a shelf drive mechanism (not shown) attached to the frame 1 to move the shelf 22 up and down, and a height detection sensor (not shown) attached to the frame 1 to detect a height of the stack of signatures S on the shelf 22.

The shelf 22 is lowered by a predetermined distance based on detection signals outputted from the height detection sensor every time the height of the stack of signatures S is increased to the predetermined distance. The shelf 22 is lowered to the lowest position thereof when the signatures S of one book block are stacked on the shelf 22.

In this embodiment, a signature detection sensor (not shown) and an image sensor (not shown) are arranged at appropriate positions upstream of the accumulation unit 5. Then when the number of the signatures S counted by the signature detection sensor reaches a predetermined value or a mark printed on a margin of a last signature S is detected by the image sensor, it is determined that the signatures S of one book block are stacked.

As shown in FIGS. 4A and 4B, the accumulation unit 5 further comprises a first jogging mechanism jogging front and back surfaces of the stack P of the signatures S on the shelf 22 and a second jogging mechanism jogging side surfaces of the stack P on the shelf 22.

A first jogging mechanism comprises a back alignment plate 23 attached to the frame 1 and arranged at an upstream end of the shelf 22 so as to be extended vertically to the shelf 22 and perpendicularly to the conveying direction (arrow A), a front alignment plate 24 arranged at downstream of and parallel with the back alignment plate 23 to jog the front and back surfaces of an upper portion of the stack P in cooperation with the back alignment plate 23, and a first alignment plate drive mechanism 25 attached to the frame 1 to reciprocate the front alignment plate 24 in the conveying direction (arrow A).

The second jogging mechanism comprises a pair of side alignment plates 26 arranged at both sides of the shelf 22 so as to be extended vertically to the shelf 22 and in the conveying direction (arrow A) to jog the side surfaces of the upper portion of the stack B and a second alignment plate drive mechanism 27 attached to the frame 1 to reciprocate one of the side alignment plates 26 perpendicular to the conveying direction (arrow A) while maintaining a predetermined distance between the side alignment plates 26.

The accumulation unit 5 further comprises a pushing mechanism (not shown) pushing the book block B from the shelf 22 lowered at the lowest position to the second press unit 6.

Referring to FIG. 1 again, the second press unit 6 comprises a horizontal conveyer belt 28 conveying the book block B discharged from the accumulation unit 5 by the pushing mechanism (not shown) to the exit 1*b* of the frame 1. A press station is provided on a medium portion of a conveyance surface of the conveyer belt 28.

The second press unit 6 further comprises a pair of vertically movable press plates 29*a*, 29*b* arranged, above the press station and parallel with each other in a width direction of the conveyer belt 28. Each of the press plates 29*a*, 29*b* extends in the conveying direction (arrow A) and a pair of plate drive mechanisms 30*a*, 30*b* arranged for concurrently moving the press plates 29*a*, 29*b* up and down.

Further, at the press station, a pair of vertical guide plates 31*a*, 31*b* are arranged at both sides of the book block B on the conveyer belt 28 so as to be extended in the conveying direction (arrow A).

The pair of press plates 29*a*, 29*b* can be moved between a standby position in which the press plates 29*a*, 29*b* separate upwardly from the book block B on the conveyer belt 28 and a press position in which the press plates 29*a*, 23*b* press both sides of a upper surface of the book block B downwardly.

Although not shown in the drawings, the pair of press plates 29*a*, 29*b*, the pair of plate drive mechanisms 30*a*, 30*b*, and the pair of guide plates 31*a*, 31*b* are supported by an appropriate support mechanism to move in a direction perpendicular to the conveying direction (arrow A), respectively.

The second press unit 6 further comprises a sensor (not shown) for detecting when the book block B arrives at the press station. The conveyer belt 28 is temporally stopped when a detection signal is outputted from this sensor, and during the temporal stopping of the conveyer belt 28, the pair of press plates 29*a*, 29*b* is moved down from the standby position to the press position and moved up from the press position to the standby position.

Thus the book block B is pressed vertically by the conveyer belt 28 and the pair of press plates 29*a*, 29*b* so that adhesion between the signatures of the book block B is stabilized.

Referring to FIG. 1 again, a front surface B1 (fold line side end faces of the signatures), a rear surface B2 (the opposite end faces of the signatures) and side surfaces B3, B4 of the book block B forms a spine, a fore edge and top and bottom edges of the book block B, respectively, and in the subsequent process, cutting of the spine B1 of the book block B, glue application and cover attachment to the cut spine B1 are sequentially performed and thereafter, the book block B with the cover is trimmed by the three side trimmer at the fore edge B2 and top and bottom edges B3 and B4 thereof so as to be shaped into a book.

Consequently, as shown in FIG. 3C, glue joints (glue G) formed between signatures during formation of the book block are cut off by three side trimming (an area drawn by hatched lines in FIG. 3C) so that the book does not have the glue joints between the signatures. Thus the book can be smoothly opened.

Furthermore, according to the present invention, the signatures S are stacked after each of the signatures S is pressed along the fold line f thereof by the first press unit 2 and thereby, as shown in FIG. 5A, warpage of the front surface (spine) B1 of the book block B is controlled. Consequently, even though a book block B is composed of a number of signatures S, book binding errors such as the occurrence of wrinkles in the signatures S can be prevented.

The pressing by the first press unit 2 is particularly effective in case of making a book block B of signatures S which are formed by multiple folding of a sheet in directions perpendicular to each other, for example, by folding a sheet in half in a width direction after folding the sheet in half in a length direction.

DESCRIPTION OF REFERENCE NUMERALS

1 Frame
1*a* Entrance
1*b* Exit
2 First press unit
3 Signature conveyance unit
4 Glue application unit
5 Accumulation unit
6 Second press unit
7*a*, 7*b* Press roller
8*a*, 8*b* Auxiliary press roller
9 Signature feed unit
9*a*, 9*b* Conveyer belt
10 Upstream conveyer belt
11 Downstream conveyer belt
12 Alignment ruler
13 Conveyer belt
14 Slide guide
15, 16 Glue injection head
15*a*, 16*a* Glue injection nozzle
17 Head drive mechanism
18*a*, 18*b* Ball screw
19*a*, 19*b* Motor
20*a*, 20*b* Nut member
21*a*, 21*b* Sensor
22 Shelf
23 Back alignment plate
24 Front alignment plate
25 First alignment plate drive mechanism
26 Side alignment plate
27 Second alignment plate drive mechanism
28 Conveyer belt
29*a*, 29*b* Press plate
30*a*, 30*b* Plate drive mechanism
A Conveying Direction of signatures
B Book block
B1 Spine
B2 Fore edge
B3, B4 Top and bottom edges
f Fold line
G Glue
K Book block
K1, K2 Side surface
M Signature
n Fold line
P Stack of signatures
S Signature
V Cover
w Glue joint

The invention claimed is:

1. A book block forming apparatus comprising:

a frame having an entrance and an exit;

a first press unit attached to the entrance of the frame to press each of signatures along a fold line thereof, the signatures being supplied one by one into the first press unit from the fold line as a leading edge of the signature;

a signature conveyance unit attached to the frame and arranged downstream of the first press unit to convey the signatures received from the first press unit while controlling attitudes of the signatures in a manner such that the fold lines are perpendicular to the conveying direction;

a glue application unit attached to the frame and arranged downstream of the signature conveyance unit to apply glue to both sides of the top face of each of the signatures received by the signature conveyance unit;

an accumulation unit attached to the frame and arranged downstream of the glue application unit to form a book block by stacking the signatures received from the glue application unit while jogging the stack of signatures; and a second press unit attached to the frame and arranged downstream of the accumulation unit to receive and vertically press the book block fed from the accumulation unit and discharge the pressed book block from the exit of the frame.

2. The book block forming apparatus according to claim 1, wherein the glue application unit comprises:

a first conveyer belt attached to the frame to convey the signatures received from the signature conveyance unit;

one or more slide guides attached to the frame and arranged above the first conveyer belt so as to be extended perpendicularly across the first conveyer belt;

a pair of glue injection heads slidably mounted on the slide guides and having one or more glue injection nozzles to spray glue in both sides of upper surfaces of the signatures being conveyed by the first conveyer belt;

a first drive mechanism attached to the frame to slide the pair of glue injection heads; and one or more first sensors arranged upstream of the pair of glue injection heads to detect passage of front ends of the signatures, wherein the pair of glue injection heads is activated by detection signals outputted from the first sensors.

3. The book block forming apparatus according to claim 2, wherein the first drive mechanism of the glue application unit comprises:

a pair of ball screws arranged above both sides of the first conveyer belt, each of the ball screws extending parallel with the slide guides and supported by the frame so as to be rotatable about an axis thereof;

a pair of motors attached to the frame and arranged at both sides of the first conveyer belt to rotate the associated ball screws; and a nut member engaged with each of the ball screws, the glue injection heads being attached to the associated nut members.

4. The book block forming apparatus according to claim 3, wherein the accumulation unit comprises:

a vertically movable shelf arranged downstream of a downstream end of the first conveyer belt of the glue application unit, the signatures discharged from the first conveyer belt being stacked on the shelf;

a second drive mechanism attached to the frame to move the shelf up and down;

a height detection sensor attached to the frame to detect a height of the stack of signatures on the shelf, the shelf being lowered by a predetermined distance based on detection signals of the height detection sensor every time the height of the stack of signatures is increased to the predetermined distance;

a first jogging mechanism jogging front and back surfaces of the stack of signatures on the shelf; and a second jogging mechanism jogging side surfaces of the stack of signatures on the shelf, wherein the first jogging mechanism comprises:

a back alignment plate attached to the frame and arranged at an upstream end of the shelf so as to be extended vertically to the shelf and perpendicularly to the conveying direction;

a front alignment plate arranged at downstream of and parallel with the back alignment plate to jog the front and back surfaces of an upper portion of the stack of signatures in cooperation with the back alignment plate; and a third drive mechanism attached to the frame to reciprocate the front alignment plate in the conveying direction, wherein the second jogging mechanism comprises:

a pair of side alignment plates arranged at both sides of the shelf so as to be extended vertically to the shelf and in the conveying direction to jog the side surfaces of the upper portion of the stack of signatures; and a fourth drive mechanism attached to the frame to reciprocate one of the side alignment plates perpendicular to the conveying direction while maintaining a predetermined distance between the side alignment plates, wherein the accumulation unit further comprises a pushing mechanism pushing the book block from the shelf lowered at the lowest position to the second press unit.

5. The book block forming apparatus according to claim 4, wherein the first press unit comprises:

a pair of horizontal press rollers arranged one above the other so as to be extended perpendicular across the conveying direction and supported by the frame to be rotatable about axes thereof; and a fifth drive mechanism attached to the frame to rotate the horizontal press rollers.

6. The book block forming apparatus according to claim 5, wherein the second press unit comprises:

a second horizontal conveyer belt conveying the book block discharged from the accumulation unit by the pushing mechanism to the exit of the frame, a press station being provided on a medium portion of a conveyance surface of the second conveyer belt;

a pair of vertically movable press plates arranged above the press station and parallel with each other in a width direction of the second conveyer belt, each of the press plates extending in the conveying direction;

a sixth drive mechanism arranged for concurrently moving the press plates up and down in a manner such that the press plates can be moved between a standby position in which the press plates separate upwardly from the book block on the second conveyer belt and a press position in which the press plates press both sides of a upper surface of the book block downwardly; and a second sensor for detecting when the book block arrives at the press station, wherein the second conveyer belt is temporally stopped when a detection signal is outputted from the second sensor, and during the temporal stopping of the second conveyer belt, the pair of press plates is moved down from the standby position to the press position and moved up from the press position to the standby position.

7. The book block forming apparatus according to claim 6, wherein the signature conveyance unit comprises:

a third horizontal conveyer belt attached to the frame and arranged at an angle with respect to the conveying direction to convey the signatures from the first press unit to the first conveyer belt;

an alignment ruler extending in the conveying direction on the conveyance surface of the third conveyer belt; and a seventh drive mechanism attached to the frame to support the alignment ruler and move the alignment ruler in a direction perpendicular to the conveying direction.

* * * * *